US009753478B2

(12) United States Patent
Wiemeyer

(10) Patent No.: US 9,753,478 B2
(45) Date of Patent: Sep. 5, 2017

(54) TEMPERATURE COMPENSATED CURRENT LIMITING MECHANISM

(71) Applicant: Electro-Motive Diesel, Inc., LaGrange, IL (US)

(72) Inventor: James F. Wiemeyer, Homer Glen, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 578 days.

(21) Appl. No.: 14/298,805

(22) Filed: Jun. 6, 2014

(65) Prior Publication Data

US 2015/0355661 A1 Dec. 10, 2015

(51) Int. Cl.

| | |
|---|---|
| ***B61L 23/16*** | (2006.01) |
| ***G05F 3/02*** | (2006.01) |
| ***G05F 1/573*** | (2006.01) |
| ***B61L 15/00*** | (2006.01) |

(52) U.S. Cl.

CPC ..... *G05F 3/02* (2013.01); *B61L 15/0027* (2013.01); *B61L 15/0036* (2013.01); *B61L 15/0081* (2013.01); *G05F 1/573* (2013.01)

(58) Field of Classification Search

None

See application file for complete search history.

(56) References Cited

U.S. PATENT DOCUMENTS

| | | | | |
|---|---|---|---|---|
| 5,587,649 | A | 12/1996 | Garrett | |
| 5,859,557 | A * | 1/1999 | Schley-May | H03H 11/48 327/108 |
| 2008/0253155 | A1* | 10/2008 | Peng | H02M 1/32 363/50 |
| 2013/0141070 | A1* | 6/2013 | Goessling | H02M 3/156 323/284 |

* cited by examiner

*Primary Examiner* — Jared Fureman
*Assistant Examiner* — Aqeel Bukhari
(74) *Attorney, Agent, or Firm* — Finnegan, Henderson, Farabow, Garrett & Dunner, LLP

(57) ABSTRACT

The present disclosure is directed to a current limiting circuit. The current limiting circuit may include a load, a first switch that controls current supplied to the load, and a first resistive network. The current limiting circuit may further include a voltage divider connected across the first resistive network and including a thermistor. The current limiting circuit may further include a first bipolar junction transistor that controls switching of the first switch. The output terminal of the voltage divider may be connected to a base junction of the first bipolar junction transistor.

20 Claims, 5 Drawing Sheets

TEMPERATURE COMPENSATED CURRENT LIMITING MECHANISM

TECHNICAL FIELD

The present disclosure relates generally to electrical systems, and more particularly to electrical systems including a temperature compensated current limiting mechanism.

BACKGROUND

Traditional locomotives are known to use several on-board electrical systems to drive an output or load. Similarly, other electronic devices such as portable hand-held or wireless devices include load-driving circuitry. Typically, such electrical systems and devices include mechanisms to limit the amount of current that may be supplied to the load or output circuit. One such mechanism is a current limiter, which limits the current that may be supplied to the load or output circuit.

A conventional current limiting circuit 200 is illustrated in FIG. 2 that limits the current supplied to load 201. Circuit 200 uses the base-to-emitter voltage, or $V_{EB}$, of PNP transistor Q1 to limit the current when load 201 attempts to draw current that exceeds a predetermined limit value. As the load 201 draws increasing current, the $V_{EB}$ of transistor Q1 increases from 0 mV to 650 mV based on the voltage drop across resistor $R_{SENSE}$. A $V_{EB}$ of 650 mV begins to "turn on" the PNP transistor Q1, which increases the voltage drop across resistor $R_{GATE}$. This increase in the voltage across resistor $R_{GATE}$ begins to "turn off" PMOS (or p-type MOSFET) Q2 because the gate voltage of PMOS Q2 begins to increase. This turning off of Q2 continues until the current limit is reached. The above configuration actively limits the load current in this manner. The arithmetic expression of the current limit value ($I_{LIM}$) at room temperature may be given by:

$$I_{LIM}=V_{BE}\div R_{SENSE}\approx 0.650\text{V}\div R_{SENSE} \quad (1)$$

Equation (1) above shows that one may select a current limit value by means of selecting an appropriate $R_{SENSE}$ resistor. In FIG. 2, circuit 200 limits the current deliverable to load 201 at approximately 217 mA (217 mA≈650 mV÷3Ω).

Circuit 200, however, suffers from variation over temperature, since the $V_{EB}$ of Q1 depends upon temperature for a given emitter-base current. An emitter-base current that produces a $V_{EB}$ of 650 mV at 25° C. produces approximately 800 mV at −40° C. and 420 mV at 150° C. That is, the threshold $V_{EB}$ value at which Q1 "turns on" increases with a decrease in temperature. It will be apparent from equation (1) that such a change in the $V_{EB}$ threshold value from 650 mV at room temperature will result in a large variation in the current limit for load 201. Specifically, the load current will limit at too high for low temperatures, and too low at high temperatures.

U.S. Pat. No. 5,587,649 discloses a scheme that recognizes the variation in the $V_{EB}$ threshold value for transistor Q1 in a current limiting circuit. The '649 patent suggests replacing sense resistor $R_{SENSE}$ with a combination of resistors including a thermistor having a negative temperature coefficient.

While the '649 patent may disclose a current limiting circuit that may take into account the variation in the $V_{EB}$ threshold value for transistor Q1, the disclosed current limiting circuit does not attempt to maintain a low variation in the current limit over a wide temperature range. Instead, the disclosed current limiting circuit assumes that the maximum current demand of load 201 changes over temperature and the current limit tracks this change in current demand over temperature. Accordingly, the disclosed current limiting circuit may not be able to provide a low variation in the current limit over a wide temperature range.

Further, the disclosed current limiting circuit may not be useful for systems in which a high load current is required. This is because commercially available thermistors have a large resistance value as a result of which the combination of resistors including the thermistor will have a large effective resistance. As a result, a low load current (of the order of milli-amps) will cause a large voltage drop across the resistor combination sufficient to "turn on" transistor Q1, thereby limiting the load current to the milli-amps range.

The presently disclosed current limiting circuit and system including the same is directed to overcoming one or more of the problems set forth above and/or other problems in the art.

SUMMARY

In accordance with one aspect, the present disclosure is directed to a current limiting circuit. The current limiting circuit may include a load, a first switch that controls current supplied to the load, and a first resistive network. The current limiting circuit may further include a voltage divider connected across the first resistive network and including a thermistor. The current limiting circuit may further include a first bipolar junction transistor that controls switching of the first switch. The output terminal of the voltage divider may be connected to a base terminal of the first bipolar junction transistor.

According to another aspect, the present disclosure is directed to a locomotive. The locomotive may include a first electrical module and a second electrical module driven by the first electrical module. The second electrical module may include a load, a first switch that controls current supplied to the load, and a first resistive network. The second electrical module may further include a voltage divider connected across the first resistive network and including a thermistor. The second electrical module may further include a first bipolar junction transistor that controls switching of the first switch. The output terminal of the voltage divider may be connected to a base terminal of the first bipolar junction transistor.

DETAILED DESCRIPTION

Figure 1:
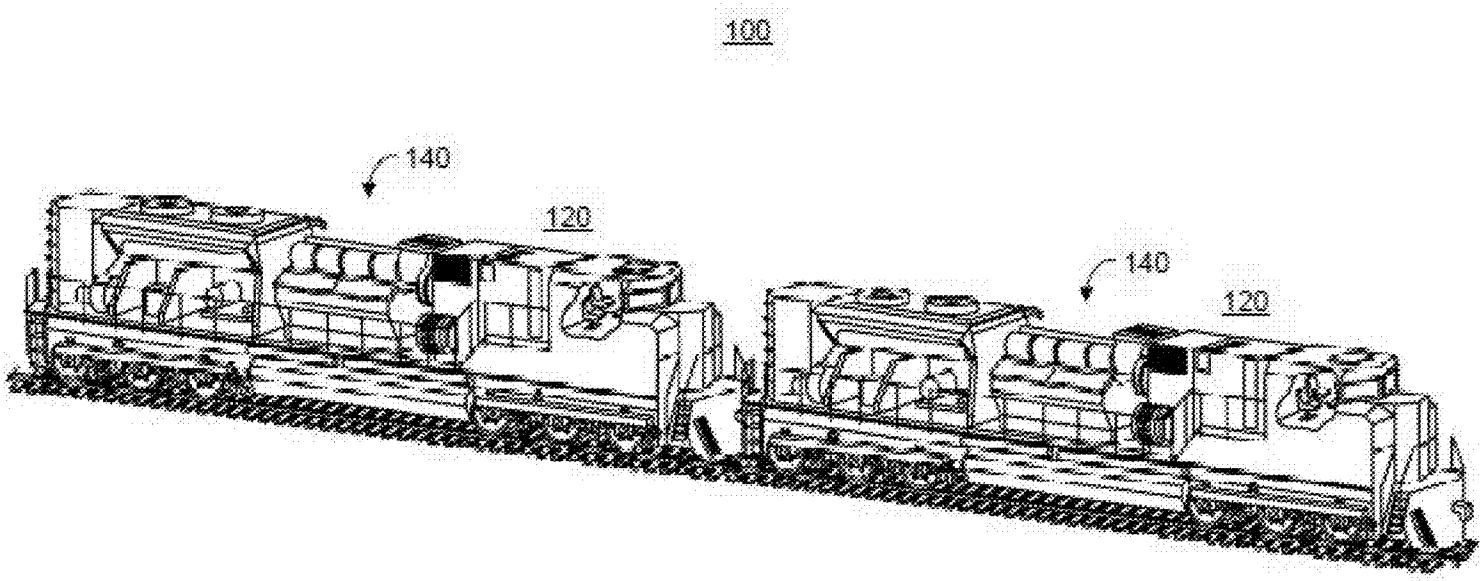
FIG. 1 illustrates a pictorial view of an exemplary consist of two locomotives.
Figure 2:
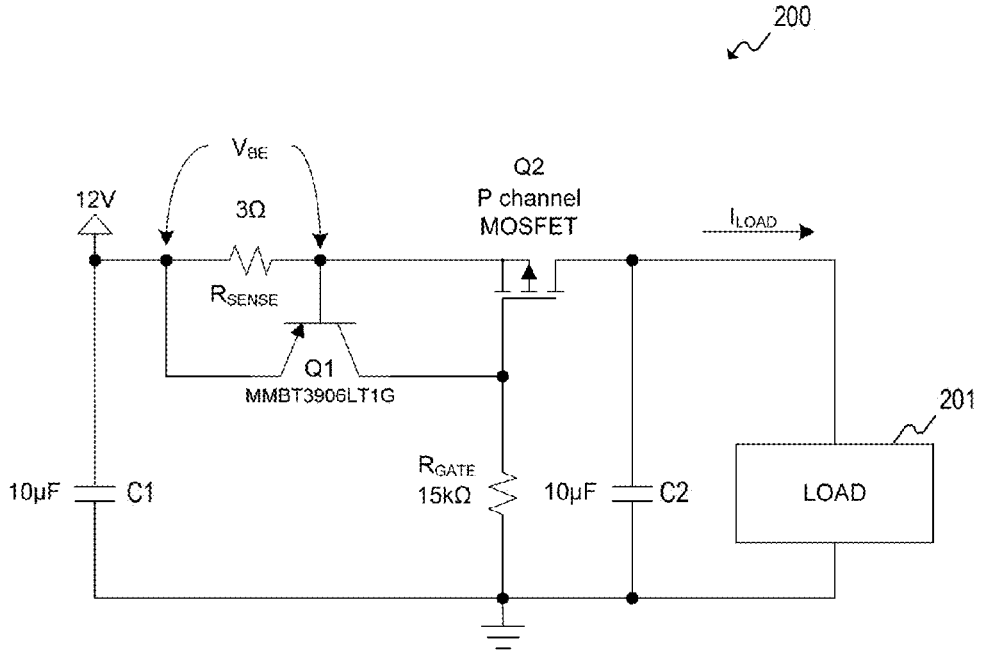
PRIOR ART FIG. 2
FIG. 2 illustrates a conventional current limiting circuit.

FIG. 1 illustrates a consist 100 comprising a plurality of locomotives 120, the plurality including at least a first and a last locomotive 120. Each locomotive 120 may include a locomotive engine 140. In one embodiment, locomotive engine 140 may comprise a uniflow two-stroke diesel engine system. Those skilled in the art will also appreciate that each locomotive 120 may also, for example, include an operator cab (not shown), facilities used to house electronics, such as electronics lockers (not shown), protective housings for locomotive engine 140 (not shown), and a generator used in conjunction with locomotive engine 140 (not shown).

While not shown in FIG. 1, consist 100 may comprise more than two locomotives 120. Additionally, consist 100 may also comprise a variety of other railroad cars, such as freight cars or passenger cars, and may employ different arrangements of the cars and locomotives to suit the particular use of consist 100. In an embodiment, the locomotives within consist 100 communicate with each other through, for example, wired or wireless connections between the locomotives. Particular examples of such connections may include, but are not limited to, a wired Ethernet network connection, a wireless network connection, a wireless radio connection, a wired serial or parallel data communication connection, or other such general communication pathway that operatively links control and communication systems on-board respective locomotives of a consist.

Figure 3:
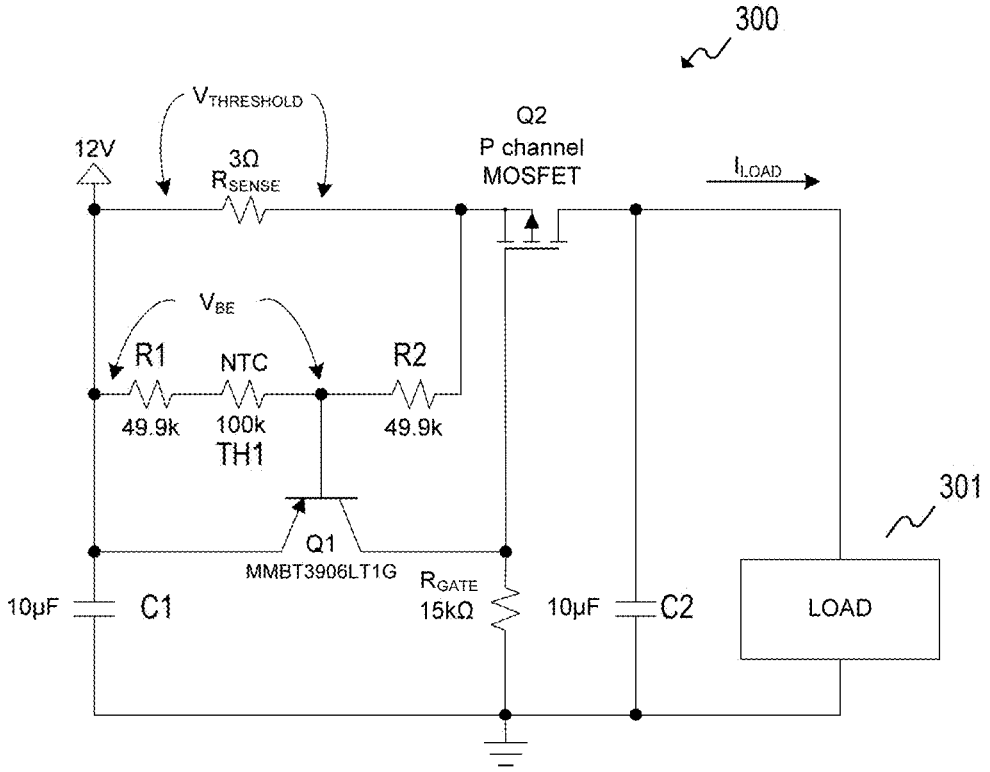
FIG. 3 illustrates an exemplary temperature compensated current limiting circuit that may be provided in an electrical system of the locomotive of FIG. 1.

FIG. 3 illustrates an exemplary temperature compensated current limiting circuit 300 limiting the current supplied to load 301. Circuit 300 operates from a power supply of 12V. It will be apparent, however, that the power supply value can be any other value, which is large enough to properly bias the components to the right of PNP transistor Q1. For example, the power supply could be 2.5V, 3.5V, 5.5V, etc.

Like circuit 200, circuit 300 also includes PMOS Q2, capacitors C1, C2, and resistors $R_{GATE}$ and $R_{SENSE}$. While the embodiment discloses capacitors C1 and C2 as having a value of 10 μF, it will be understood that any suitable value may be used for capacitors C1 and C2. Similarly, the value of $R_{GATE}$ as 15 kohms is arbitrary and any other suitable value may be used. The value of $R_{SENSE}$ is also arbitrary (here 3 ohms) and can be adjusted based on the desired current limit.

Compared to circuit 200, circuit 300 may include a voltage divider formed by resistor R1, negative temperature coefficient thermistor TH1, and resistor R2. One end of the voltage divider may be connected to one end of $R_{SENSE}$ and the other end of the voltage divider may be connected to the other end of $R_{SENSE}$. Exemplarily, R1 and R2 may have a value of 49.9K and thermistor TH1 may have a resistance value of 100K at room temperature. It will be understood that these values are only exemplary, and that R1, R2, and TH1 may take on other values. The base terminal of the PNP transistor Q1 may be connected to the output of the voltage divider such that thermistor TH1 is connected between the base and emitter terminals of PNP transistor Q1. Next, the temperature compensation aspect of circuit 300 will be explained.

As discussed in the background section, the threshold $V_{EB}$ value for transistor Q1 increases with a decrease in temperature and decreases with an increase in temperature. As a result, for example, when the temperature increases, a lower load current will be sufficient to create a voltage drop across $R_{SENSE}$ that is enough to "turn on" transistor Q1. In circuit 300, since thermistor TH1 has a negative temperature coefficient, TH1's resistance value decreases with an increase in temperature. Accordingly, the decrease in the $V_{EB}$ threshold is compensated by a decrease in the output voltage of the voltage divider, where the output voltage of the voltage divider equals $V_{EB}$. Similarly, if the temperature decreases, the resistance of TH1 increases to compensate for an increase in the $V_{EB}$ threshold for transistor Q1.

Figure 4:
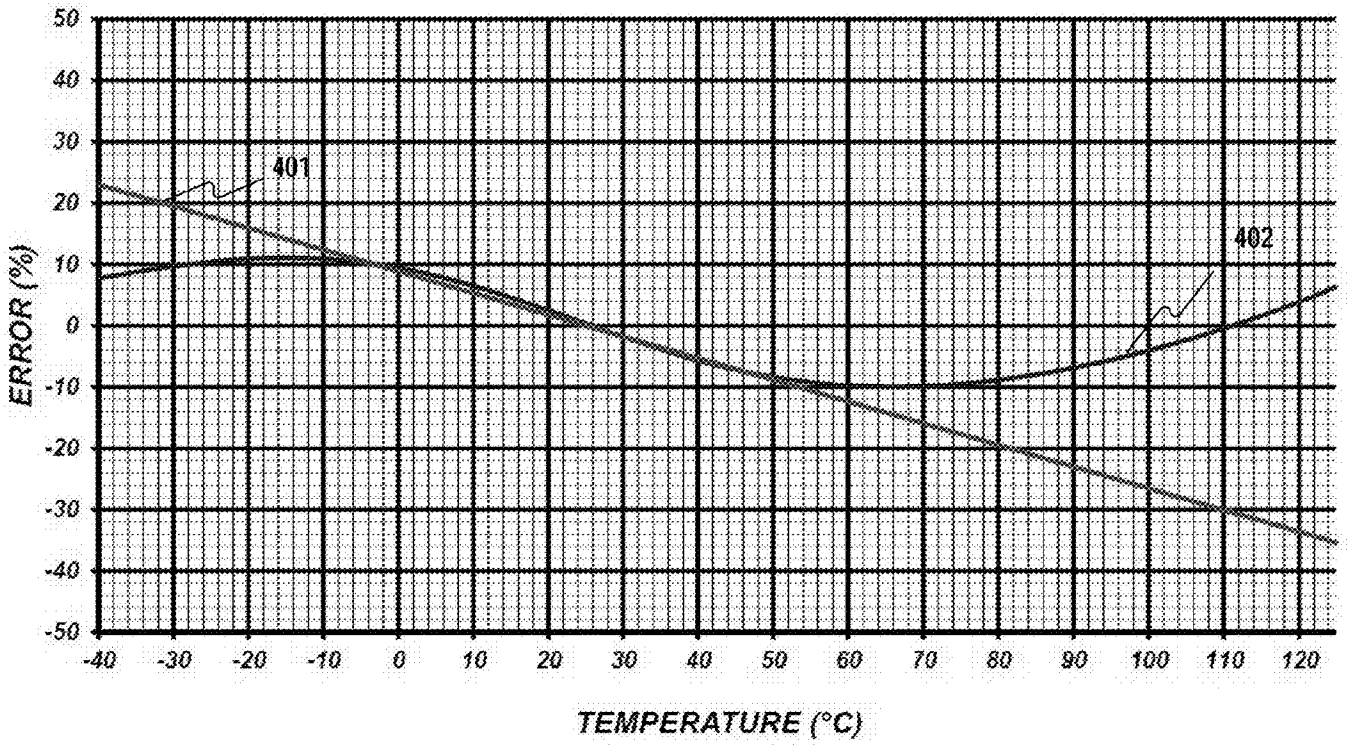
FIG. 4 illustrates a difference in variation in the current limit between the circuit of FIGS. 2 and 3.

FIG. 4 illustrates the variation in current limit between the conventional circuit 200 and the disclosed exemplary circuit 300 across a wide range of temperatures. Line 401 is the variation of the current limit for the conventional circuit 200 and line 402 is the variation of the current limit for the disclosed circuit 300. As can be seen from FIG. 4, the variation in the current limit from the room temperature current limit decreased to about ±10% overall for circuit 300 compared to roughly +23% at −40° C. and −35% at 120° C. for circuit 200. The graphical illustration of the current limit variation employed the Murata part number NCP15WF104F03RC for the negative temperature coefficient thermistor TH1.

Various modifications can be made to circuit 300. For example, in a functionally equivalent circuit 300, the p-type transistor Q1 could be replaced by an n-type transistor Q1. Similarly, the p-type MOSFET Q2 may be replaced by an n-type MOSFET Q2. Moreover, Q1 may be replaced by a comparator circuit.

Figure 5:
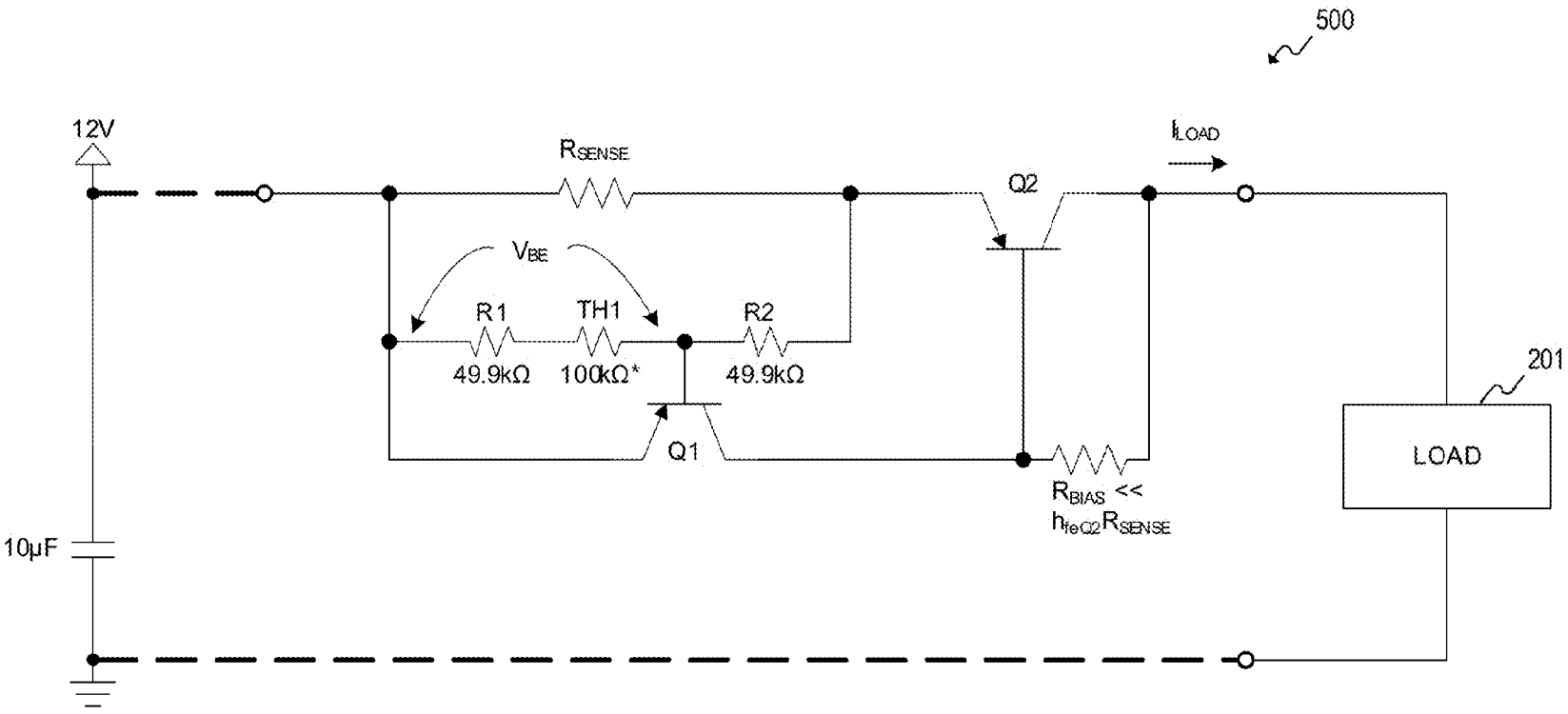
FIG. 5 illustrates an exemplary temperature compensated current limiting circuit that may be provided in an electrical system of the locomotive of FIG. 1.

FIG. 5 illustrates another exemplary temperature compensated current limiting circuit 500 limiting the current supplied to load 201. Like the circuit in FIG. 3, a voltage divider formed by a negative temperature coefficient resistor (TH1) with resistances R1 and R2 drives the base of transistor Q1. An increase or decrease in resistance of TH1 with a change in temperature compensates for the corresponding change in $V_{EB}$ threshold for transistor Q1. Further, MOSFET Q2 in circuit 300 has been replaced with a bipolar junction transistor Q2.

Additionally, resistor $R_{GATE}$ in circuit 300 has been replaced with resistor $R_{BIAS}$ which is connected with the base and collector junctions of transistor Q2. It will be apparent to a skilled artisan that circuit 500 could also serve its purpose if resistor $R_{GATE}$ was provided in circuit 500 like in circuit 300.

INDUSTRIAL APPLICABILITY

The disclosed current limiting circuit may provide a low variation in the current limit over a wide temperature range. By providing a negative temperature coefficient thermistor in the base drive of transistor Q1, the temperature variance of the threshold $V_{EB}$ value can be compensated. Moreover, the disclosed current limiting circuit may have an advantage over conventional circuits in that the current limiting circuit 300 may be operable for both small and large load currents. This operation over a wide load current range is made possible by the provision of two separate paths to transistor Q2—a first low resistance path through $R_{SENSE}$ and a second high resistance path through the voltage divider. Most of the load current will flow through $R_{SENSE}$, whose value can be adjusted based on the desired load current operating range.

It will also be understood that circuit 300 can be employed in an electrical module of locomotive 100 that is being driven by another electrical module of locomotive 100. Moreover, it will be apparent that circuit 300 may be utilized in any electrical system where a current limiting mechanism is desired. For example, circuit 300 may be utilized in a battery pack. Circuit 300 may be utilized, for example, in a handheld device where a current limiting mechanism is desired.

It will be apparent to those skilled in the art that various modifications and variations can be made to the disclosed current limiting circuit. Other embodiments will be apparent to those skilled in the art from consideration of the specification and practice of the disclosed circuit. It is intended that the specification and examples be considered as exemplary only, with a true scope being indicated by the following claims and their equivalents.

What is claimed is:

1. A current limiting circuit comprising:

a load;

a first switch that controls current supplied to the load;

a first resistive network;

a voltage divider connected across the first resistive network and including a thermistor; and a first bipolar junction transistor that controls switching of the first switch, wherein an output terminal of the voltage divider is directly connected to a base terminal of the first bipolar junction transistor.

2. The current limiting circuit of claim 1, wherein the thermistor has a negative temperature coefficient.

3. The current limiting circuit of claim 1, wherein the first bipolar junction transistor is an NPN bipolar junction transistor.

4. The current limiting circuit of claim 1, wherein the first bipolar junction transistor is a PNP bipolar junction transistor.

5. The current limiting circuit of claim 1, wherein the first switch is a MOSFET and a collector terminal of the first bipolar junction transistor is connected to a gate of the MOSFET.

6. The current limiting circuit of claim 1, wherein the first switch is a second bipolar junction transistor and a collector terminal of the first bipolar junction transistor is connected to a base terminal of the second bipolar junction transistor.

7. The current limiting circuit of claim 5, wherein the MOSFET is a p-type MOSFET.

8. The current limiting circuit of claim 5, wherein the MOSFET is an n-type MOSFET.

9. The current limiting circuit of claim 1, wherein the thermistor is connected between base and emitter terminals of the first bipolar junction transistor.

10. The current limiting circuit of claim 1, wherein the voltage divider includes a first and second resistor in addition to the thermistor.

11. A locomotive comprising:

a first electrical module; and a second electrical module driven by the first electrical module, wherein:

the second electrical module includes:

a load, a first switch that controls current supplied to the load, a first resistive network, a voltage divider connected across the first resistive network and including a thermistor, and a first bipolar junction transistor that controls switching of the first switch, and an output terminal of the voltage divider is directly connected to a base terminal of the first bipolar junction transistor, wherein the thermistor is connected between the base terminal and an emitter terminal of the first bipolar junction transistor.

12. The locomotive of claim 11, wherein the thermistor has a negative temperature coefficient.

13. The locomotive of claim 11, wherein the first bipolar junction transistor is an NPN bipolar junction transistor.

14. The locomotive of claim 11, wherein the first bipolar junction transistor is a PNP bipolar junction transistor.

15. The locomotive of claim 11, wherein the first switch is a MOSFET and a collector terminal of the first bipolar junction transistor is connected to a gate of the MOSFET.

16. The locomotive of claim 11, wherein the first switch is a second bipolar junction transistor and a collector terminal of the first bipolar junction transistor is connected to a base terminal of the second bipolar junction transistor.

17. The locomotive of claim 15, wherein the MOSFET is a p-type MOSFET.

18. The locomotive of claim 15, wherein the MOSFET is an n-type MOSFET.

19. A current limiting circuit for a locomotive comprising:

a load;

a first switch that controls current supplied to the load;

a first resistive network;

a voltage divider connected across the first resistive network and including a first resistor, a thermistor having a negative temperature coefficient, and a second resistor all directly connected in series; and a first bipolar junction transistor that controls switching of the first switch, wherein an output terminal of the voltage divider is directly connected to a base terminal of the first bipolar junction transistor, and wherein the thermistor is connected between the base terminal and an emitter terminal of the first bipolar junction transistor.

20. The current limiting circuit of claim 19, wherein the first switch is a second bipolar junction transistor, and a collector terminal of the first bipolar junction transistor is connected to a base terminal of the second bipolar junction transistor.

* * * * *